US006212736B1

(12) United States Patent
Vandergriff

(10) Patent No.: US 6,212,736 B1
(45) Date of Patent: Apr. 10, 2001

(54) TUBE DENSITY SEPARATOR AND METHOD

(75) Inventor: Arvel L. Vandergriff, Visalia, CA (US)

(73) Assignee: Vandergriff, Inc., Visalia, CA (US)

( * ) Notice: Subject to any disclaimer, the term of this patent is extended or adjusted under 35 U.S.C. 154(b) by 0 days.

(21) Appl. No.: 09/490,739

(22) Filed: Jan. 25, 2000

Related U.S. Application Data

(60) Provisional application No. 60/117,454, filed on Jan. 26, 1999.

(51) Int. Cl.[7] ..... D01B 1/04

(52) U.S. Cl. ..... 19/64.5; 19/48 R; 19/205; 209/139.1; 209/143

(58) Field of Search ..... 19/37, 39, 48 R, 19/50, 52, 64.5, 65 A, 200, 204, 205; 209/138, 139.1, 142, 143, 146, 147, 153

(56) References Cited

U.S. PATENT DOCUMENTS 2,848,635 * 8/1958 Raible et al. ..... 313/7
2,862,247 * 12/1958 Vandergriff et al. ..... 19/37
3,069,730 * 12/1962 Vandergriff et al. ..... 19/203
4,344,843 * 8/1982 Leifeld ..... 209/143
4,441,994 * 4/1984 Beneke et al. ..... 209/143
4,950,388 * 8/1990 Stafford ..... 209/147
4,988,373 * 1/1991 Marzoli et al. ..... 209/143
5,533,276 * 7/1996 Vandergriff ..... 34/583
5,685,434 * 11/1997 Ackerman ..... 209/142
5,829,597 * 11/1998 Bielagus ..... 209/139.1

* cited by examiner

*Primary Examiner*—John J. Calvert
*Assistant Examiner*—Gary L. Welch
(74) *Attorney, Agent, or Firm*—Richard A. Ryan

(57) ABSTRACT

A tube density separator and method for use in a cotton gin to separate cotton from a pneumatically conveyed mixture of cotton and foreign materials has a generally vertical tube for receiving the mixture and separating out the foreign material from the cotton. The bottom of the tube is larger than the outlet of the pipe transporting the mixture so the velocity of the flow will be reduced and turbulence created. This action causes the heavier foreign matter to separate from and drop out of the cotton/foreign matter mixture. One or more dispersal rods are placed inside the tube to interact with the flow of material up the tube. The dispersal rods further break apart the clumps and wads of cotton and foreign matter to facilitate the separation action. The separated out foreign matter is collected at the inlet area of the tube. A supply of air, which can be skimmed from the air flow up the tube, conveys away the foreign matter from the tube.

25 Claims, 3 Drawing Sheets

TUBE DENSITY SEPARATOR AND METHOD

CROSS-REFERENCE TO RELATED APPLICATIONS

This application claims the benefit of U.S. Provisional Application No. 60/117,454, filed Jan. 26, 1999.

BACKGROUND OF THE INVENTION

A. Field of the Invention

The present invention relates in general to the design and operation of cotton gins. More specifically, the present invention relates to apparatuses and methods of mechanically separating cotton fibers from foreign matter. Even more specifically, the present invention relates to an apparatus and method of more efficiently separating cotton fibers from foreign matter by utilizing conveying air and gravity separation.

B. Background

Cotton that is harvested from a field consists primarily of the desired cotton fibers and cotton seed and much undesirable foreign matter, such as burrs, sticks, stems and green leaf material. After harvesting, the cotton/foreign matter material is taken to a cotton gin for processing the harvested material into bulk cotton fibers and cotton seed. A large part of a modern cotton ginning plant consists of machines and processes for separating and removing foreign matter from the cotton fiber both prior to and following the actual separation of the cotton lint from the seed (the actual ginning). The machines for removing foreign matter from the seed cotton prior to the ginning are referred to as pre-cleaners. Basically there are two types of pre-cleaners: (1) extractors, which are used for separating the large particles of foreign matter from cotton fibers (for instance, as described in U.S. Pat. Nos. 2,848,635 and 2,862,247 to Vandergriff); and (2) cylinder cleaners, which remove foreign matter that was not removed by the extractor.

Most common extractors make use of cylinders covered with aggressive, hooked teeth. As the cylinders rotate, they engage the cotton fiber/foreign matter mix and drag it over a screening surface. The screening surfaces generally consist of rods or bars mounted laterally adjacent the extractor (toothed) cylinder. The rods or bars are spaced apart a sufficient distance to permit larger particles of foreign matter to separate from the cotton attached to the teeth of the cylinder. The cotton fibers and foreign matter separate centrifugally, which is commonly referred to as a "sling off" process (see U.S. Pat. No. 2,848,635 to Vandergriff). Some cotton will sling off with the foreign matter and this mass of cotton/foreign matter is passed to one or more additional toothed cylinders (i.e., extractors) where the remaining cotton is further mechanically processed and reclaimed from the foreign matter. The cotton which remains engaged by the teeth of the cylinders is doffed by a rotating brush and delivered to the next process.

The process of extracting foreign matter from the seed cotton described above is a multi-stage process. The flow of seed cotton passes through the extractor to be processed by the toothed cylinder where the teeth engage the fibers and slings off the foreign matter. This separates the flow of seed cotton into two streams, one containing good cotton and some foreign matter, the other containing primarily foreign matter and some cotton. Unfortunately, the extraction process is not complete, as not all cotton fibers remain attached to the teeth (some cotton will sling off with the foreign matter) and not all the foreign matter separates from the cotton remaining on the teeth (some foreign matter may follow the cylinder and be doffed with the cotton). The first stream, comprising cotton and some foreign matter that was doffed from the extractor cylinder, generally does not receive further extraction. Instead, it will be passed along for treatment in the cylinder cleaner for further processing to screen out the remaining small trash particles. The second stream, comprising primarily foreign matter and some cotton, will generally pass to one or more additional extractors for further treatment. The cotton from the additional extractor(s) is then joined up with the cotton from the first or prior extractors in the cylinder cleaner. The foreign material separated from the cotton by the extractors is conveyed to a waste disposal system.

To improve the foreign material removal efficiency of extractors, a number of devices have been incorporated into the cleaning process over the years. One of these devices is the use of cylinders, having vanes or blades, that rotate in the opposite direction as the extractor cylinder such that the vanes or blades strip back the foreign material from the cotton. Another device that has been commonly used with extractors is a rotating brush cylinder made up of a cylinder covered with a wire brush material that is used to doff the cotton from the extractor teeth. Also utilized are flexible steel-wire brushes and saws, either singularly or in combination with each other, that separated cotton from the foreign material, generally prior to being treated by the extractor cylinder.

Cylinder cleaners, which are generally used after the extractors described above, primarily consist of cylinders having a number of pins protruding from the surface of the cylinder. The cotton is passed between the cylinders and a screen surface that is configured to facilitate the falling out of the small particles of foreign material remaining in the cotton stream after treatment by the extractor. To improve the efficiency of the cylinder cleaners, the feeder cleaning screens are typically inclined forty to forty-five degrees so that the screen will go higher between the cylinders. Over the years, to improve the separation efficiency of the cylinder cleaners the use of heated air and deflectors have been incorporated.

The devices utilized with extractors and cylinder cleaners to improve efficiency of the mechanical separation of cotton from foreign matter are generally successful in separating most of the cotton and seed from the foreign material. However, the mechanical action of these devices, as well as the extractor itself, tend to lower the grade of the cotton by damaging the spinning value. Lower grade cotton results in lower prices for the cotton produced through the ginning process. As a result, there exists a need for an apparatus that effectively and efficiently separates cotton from foreign material without harming the value of the cotton.

SUMMARY OF THE INVENTION

The tube density separator and method of the present invention solves the problems identified above. That is to say, the present invention discloses a tube density separator and method for effectively and efficiently separating cotton fibers from the foreign material harvested with the cotton. Specifically, the present invention discloses a tube density separator and method that utilizes a stream of flowing air and the density difference between cotton and the foreign materials to separate out the foreign material from the cotton without the harm to cotton quality that results from the mechanical separation processes typically in use today. The present invention is adaptable and suitable for use in most cotton ginning plants currently in operation without major modifications to those plants.

In the primary embodiment of the present invention, the tube density separator and method utilizes a generally vertical tube having an inlet and an outlet at generally opposite ends of the tube. Preferably, the inlet is at or near the bottom of the tube and is larger in cross-sectional diameter than the outlet, located at or near the top of the tube. The tube can have a uniform taper from its inlet to the outlet. At its inlet, the tube density separator receives a flow of cotton/foreign material mixture in air flowing through a piping system. If the tube density separator is placed between the dryer, such as a jet dryer, and the cylinder cleaners, hot air from the dryer can be utilized by the tube density separator. The inlet is sized to be greater in cross-section than the discharge from the piping system so that there will be a decrease in velocity of the air and a tumbling action. The decrease in air flow rate and the tumbling action will result in the heaver foreign materials dropping out of and separating from the cotton fibers. The use of dispersing rods that extend into the tube and the flow of cotton/foreign material up through the tube, further results in the foreign material separating from the cotton and falling out the bottom of the tube at the inlet.

To carry away the foreign material that separates and falls out due to the mechanical and gravitational effects inside the tube, a supply of air is sent across the bottom of the tube in a generally perpendicular relationship to the upward flow of cotton and foreign materials. Because the foreign material separated from the main flow of cotton/foreign material will contain some cotton, it can be sent to a reclaimer or other device for further separation of the foreign material from the associated cotton fibers. After reclaiming, the cotton fibers are transferred to downstream of the tube density separator where it rejoins the cotton that has passed through the tube density separator. The supply of air for carrying away the separated foreign material can be split off from the air flow through the tube density separator by splitting it into a primary air stream and a secondary air stream at or near the tube outlet. The primary air stream will carry the separated cotton fibers to the next processing step, such as a cylinder cleaner, and the secondary air stream will be circulated around to the inlet area to become the waste conveying air stream for conveying away the foreign material that was separated from the cotton fibers inside the tube.

The apparatus and method of the present invention removes a high percentage of the material which would normally be removed by stick machine extraction. In some cases, cylinder cleaning would be the only additional cleaning needed after the tube density separator and method of the present invention. To make use of the tube density separator, the commingled mass of cotton and foreign matter must be suspended in an air stream with a conveying velocity. The most likely location for obtaining such an air stream is in the line carrying the mass to the dryer or from the dryer. This duct work can be routed to the bottom of the tube density separator of the present invention and connected to its inlet duct. A common arrangement is for this conveying air to have a conveying velocity in the range of 4,000 feet per minute, which is a good velocity with which to enter the tube density separator unit. This is hot air, preferably from the dryer and on its way to the cylinder cleaner. This provides additional drying by exposing the material to the hot air. Although the separation process in the tube and the air used in the conveying process (as described) follows a circuitous route, it ends up in the cylinder cleaner with the cotton, which is where it would have gone had it not been sidetracked through the tube density separation process described herein.

The tube density separation apparatus and system of the present invention replaces at least one mechanical separation process. Its chief advantage over the existing art is to separate foreign matter by air, rather than using saws and brushes. This "air separation" is gentler on the cotton fibers and, therefore, should result in higher grades of cotton and more money to the farmer. With further refinement, it may replace the entire mechanical extraction process altogether. The tube density separator of the present invention can be used in series with one or more additional tube density separators (as many as desired) such that multiple tube density separators are used to further separate the cotton from the foreign matter.

Accordingly, the primary objective of the present invention is to provide tube density separator and method that utilizes flowing air and the gravity difference between cotton and the foreign material to separate the cotton fibers from the foreign material.

It is also an important objective of the present invention to provide a tube density separator and method that utilizes a substantially vertical tapered tube having an inlet at or near the bottom thereof for accepting a flow of cotton having foreign material combined therewith to separate out the foreign material from the cotton fibers.

It is also an important objective of the present invention to provide a tube density separator and method that utilizes a flow of air to carry away foreign material that has been separated from a cotton/foreign material mixture in the tube density separator.

It is also an important objective of the present invention to provide a tube density separator and method that utilizes one or more dispersal rods to break apart a mixture of cotton fibers and foreign material to further facilitate the gravity separation of the foreign material from the cotton.

It is also an important objective of the present invention to provide a tube density separator and method that is adaptable to current cotton ginning plants without extensive modifications to those plants, and is suitable for use with other cotton ginning equipment.

The above and other objectives of the present invention will be explained in greater detail by reference to the attached figures and the description of the preferred embodiment which follows. As set forth herein, the present invention resides in the novel features of form, construction, mode of operation and combination of processes presently described and understood by the claims.

BRIEF DESCRIPTION OF THE DRAWINGS

In the drawings which illustrate the best modes presently contemplated for carrying out the present invention.

DETAILED DESCRIPTION

Figures 1, 2:
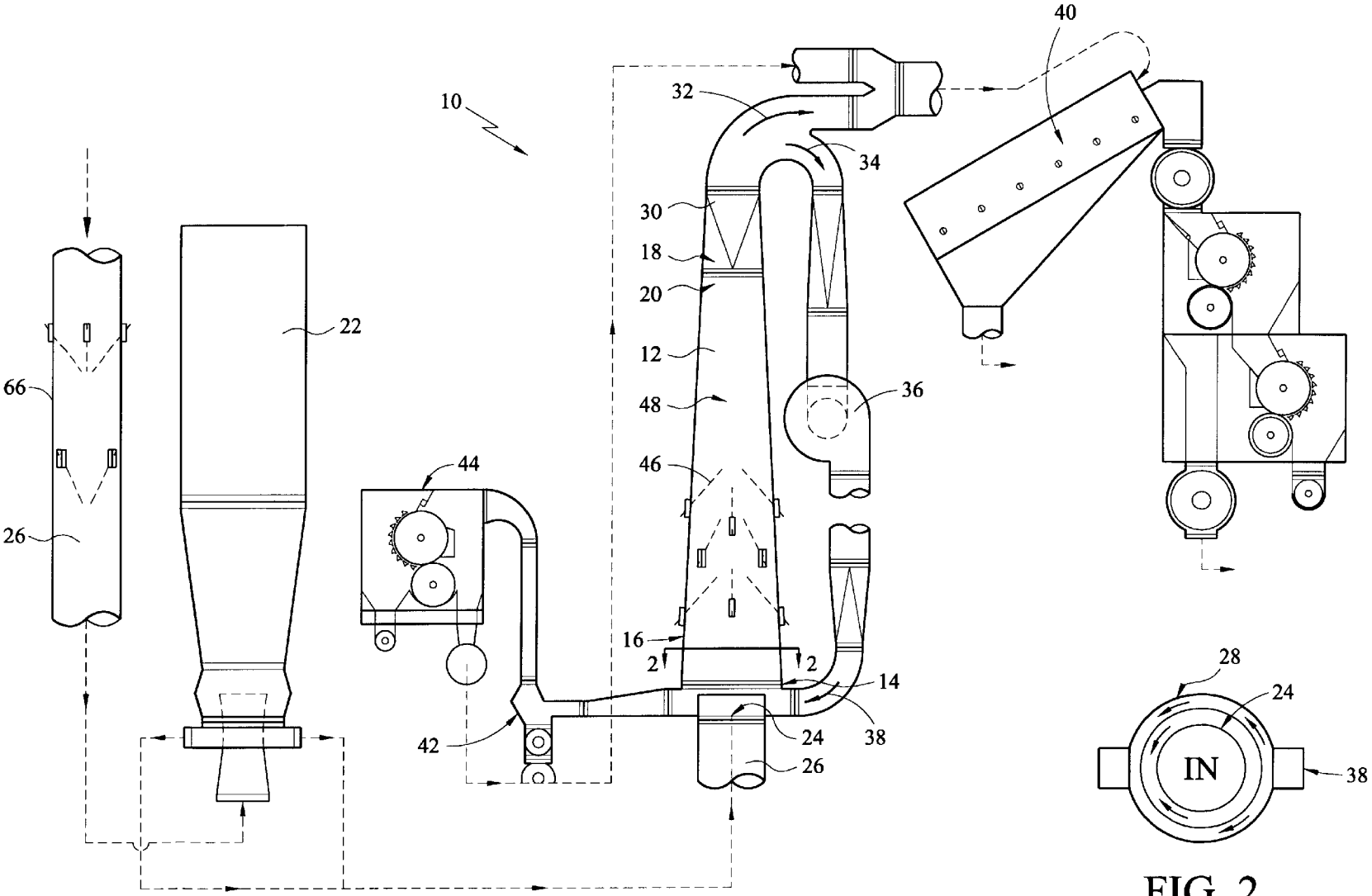
FIG. 1 is a side view of a cotton ginning process utilizing the tube density separator of the present invention.
FIG. 2 is a cross-sectional plan view of the inlet area of the generally vertical tube taken through 2—2 in FIG. 1.

With reference to FIGS. 1 through 4, where like elements have been given like numerical designations to facilitate understanding of the present invention, the tube density separator of the present invention is designated generally 10. The inventor has found that the initial separation of the cotton/foreign matter harvested from the field can be more easily and efficiently made through a process of density separation. This process can be done in a single stage or in multiple stages, i.e., with the use of one or more tube density separators in series, and can essentially eliminate the need for mechanical separation by the extractors.

The tube density separator 10 primarily comprises a generally vertical tube 12 into which the flow of cotton and foreign material in an air stream is projected at a conveying velocity. Tube 12 has a relatively large cross-section at its inlet 14 located at the bottom 16 of tube 12. Generally opposite inlet 14 is outlet 18 located at or near the top 20 of tube 12. In the preferred embodiment of the present invention, tube 12 has a uniform taper from bottom 16 to top 20 of tube 12. The uniform taper facilitates the conveying of the cotton materials up to and past outlet 18 of tube 12. The cotton, containing the foreign material, entering tube 12 at its inlet is transported by a flow of air, preferably, from a dryer unit, such as the jet dryer 22 shown in FIG. 1. As such, the air will be heated and the cotton/foreign matter mixture will be relatively free of or have a low amount of liquid content. The dry cotton mixture in hot air further facilitates the operation of the present invention.

Pipe outlet 24 of the pipe 26 transporting the cotton/foreign matter mixture from jet dryer 22 in a ginning plant will have a fixed diameter, commonly twenty-four inches. The inlet 14 of tube 12 should have a diameter (i.e., thirty-six inches) that is greater than the diameter of pipe outlet 24 to permit the cotton/foreign material mass to lose velocity and drop out some of the foreign matter, which is of greater density than the cotton, from the cotton. This density difference applies to just about all foreign matter, even a grain of sand. Foreign matter and some cotton will accumulate temporarily at the bottom 14 of tube 12, where the high velocity inlet air causes a tumbling action, which causes some of the heavier particles to fall out. The cotton which is in the tumbling mass will be conveyed upward through tube 12 as it is freed from the mass of foreign matter. The cross-sectional diameter of outlet 18 can be approximately the same as that of pipe outlet 24 so that the air flow in tube 12 will return to its initial conveying velocity.

An important factor in the success of the tube density separator 10 of the present invention is the method of getting the separated foreign matter out of the unit 10. The inventor has found that one such way for removing this material from the unit is by having it fall through an opening into a air stream moving across inlet 14 of tube 12 in a generally perpendicular relationship to the upward flow of air and cotton/foreign materials, as shown in FIGS. 1 and 2, so as to convey the fallen material away. One way to accomplish this is through the use of an arrangement similar to that used with the dryer unit and process described in U.S. Pat. No. 5,533,276 to Vandergriff. As shown in FIG. 2, the preferred mechanism for receiving and removing the foreign material that separates from the cotton is to utilize a configuration that includes a generally circular pipe 28 that goes around the pipe which pneumatically conveys the cotton/foreign matter mixture to the tube 12. The source of air conveying the cotton/foreign matter mixture enters inlet 14 from pipe 26 (the center of FIG. 2) in a generally upward direction. The air in circular pipe 28 that is used to transport away the foreign matter goes around pipe 26. The foreign mater falls into the open portion of circular pipe 28 that faces generally upward to receive the foreign matter. The outer edges of circular pipe 28 is enclosed by the outer edge of the bottom 16 of tube 12.

In the preferred embodiment of the present invention, a source of air is used to convey the material away. One method of supplying the air for conveying the foreign matter from the tube density separator 10 is with the use of skimmer 30 at the top 20 of tube 12. Alternatively, a separate source of air (i.e., not part of the supply of air that carries the cotton/foreign matter material) can be utilized to convey the foreign material away from tube 12. The preferred method of supplying air for the waste conveying air stream is to use skimmer 30 (such as that which is described in U.S. Pat. No. 3,069,730 to Vandergriff) to separate the flow of air up tube 12 into two approximately equal flow air streams, a primary air stream 32 containing cotton and (likely) some remaining foreign matter and a secondary air stream 34 having no cotton or other materials. As shown in FIG. 1, the secondary air stream 34 is passed through booster fan 36 to supply air to move the cotton and foreign matter out of the tube density separator 10 through use of circular pipe 28 (as shown in FIG. 2). It is important to balance the system so that no more than a small portion of the air from the waste conveying air stream 38 finds its way back into tube 12, thereby flowing against the discharge of foreign matter. This balance can be accomplished with simple valves that can be adjusted to obtain the necessary air dynamics at the exit of skimmer 30 and elsewhere in the system. A slight positive pressure will eliminate excess amounts of air from re-entering tube 12. In the preferred embodiment, the cotton and the other half of the air discharging from the skimmer 30 at the top 20 of tube 12, flowing in primary air stream 32, goes to cylinder cleaner 40 for further cleaning.

The waste conveying air stream 38 from tube density separator 10 of the present invention containing the foreign matter, as well as some cotton, can convey the foreign matter to one or more additional treatment devices. For instance, the foreign matter may be conveyed to a green boll trap 42, shown in FIG. 1, which is also a type of density separator, where green bolls, rocks and other heavy particles are dropped out into a screw conveyor. The green boll trap 42 is a simple device generally known in the industry. From trap 42, conveying air can deliver the foreign matter (and associated cotton) to reclaimer 44 consisting of a toothed cylinder and a doffer, similar to that described above for the extractor. In the reclaimer, the foreign matter is separated from the conveying air by centrifugal action, taking the foreign matter on to the toothed cylinder, while the air by-passes down a passage in the front of the machine. The toothed cylinder passes the material over grid bars spaced so that the foreign matter can pass while the cotton is engaged by the teeth on the cylinder until doffed by the rotating brush. The cotton is doffed back into the air stream which delivers it to the reclaimer. This "good" cotton from the toothed cylinder, with its conveying air, rejoins the primary air stream carrying the cotton after the skimmer 30 to cylinder cleaner 40. This, of course, can be done at any convenient point in the conveying line. As with the foreign matter separated by the tube density separator 10, the foreign matter separated out through the grids of reclaimer 44 is conveyed to a waste system.

Figure 4:
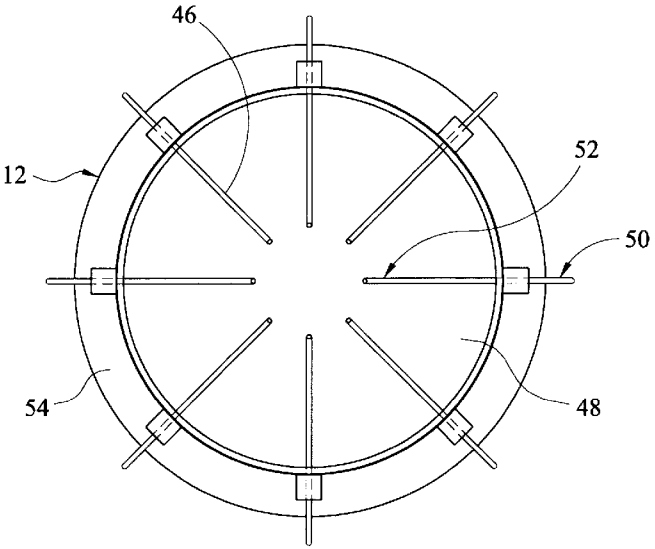
FIG. 4 is a cross-sectional plan view of the generally vertical tube taken through 4—4 in FIG. 3.
Figure 3:
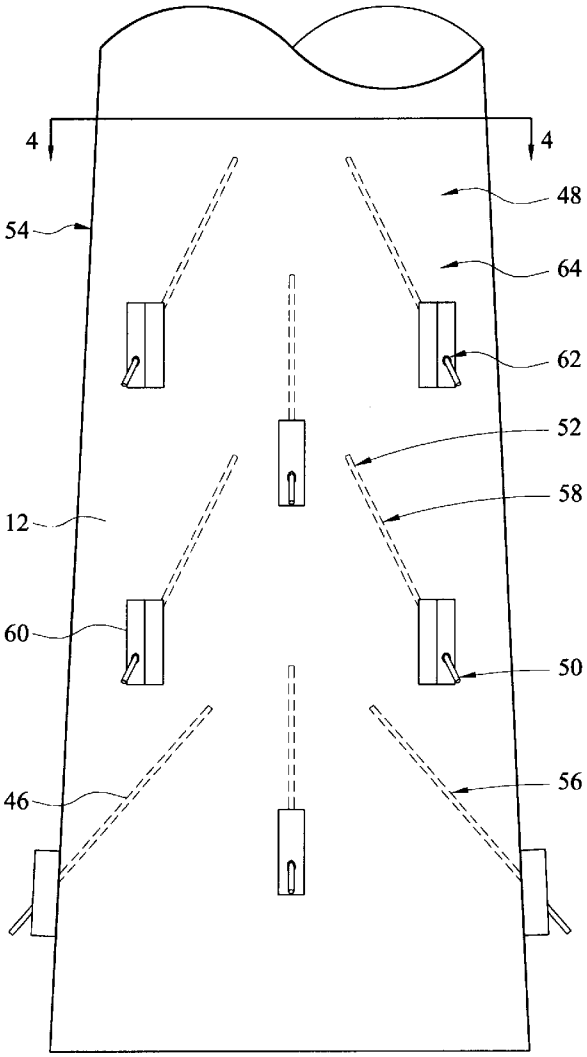
FIG. 3 is a view of the generally vertical tube for use in the present invention showing a possible placement of the dispersing rods.

The preferred embodiment of the present invention also utilizes one or more dispersal rods 46 positioned inside, at least partially, the interior 48 of tube 12, as shown in FIGS. 1, 3 and 4, to break up clumps and wads of cotton so as to further enhance the removal of trash and moisture from the cotton fibers. The need for dispersal rods 46 arises because the conveyance of fibrous materials in an air stream that flows through a piping system, having elbows and changes in velocity, tends to result in the conveyed material being formed into clumps and wads. To further improve the efficiency of the separation that is provided by the tube density separator 10, these clumps and wads should be broken up and dispersed throughout the air stream.

The preferred method of breaking up the clumps and wads is shown in FIGS. 1, 3 and 4. As shown in these figures, one or more dispersal rods 46, having a proximal end 50 and distal end 52, are inserted through the wall 54 of tube 12 such that distal end 52 is in the air stream that is conveying the cotton materials through the interior 48 of tube 12. The configuration shown in FIG. 1 utilizes two groups of rods 46 projecting into tube 12, a lower group 56 having four rods and an upper group 58 having four rods (the lower group 56 being the group lower in the flow through tube 12). In the preferred embodiment, each rod 46 slidably projects through block 60 mounted on the side wall 54 of tube 12 into the air stream that carries the cotton through the interior 48 of tube 12. The blocks 60 should have a sealing mechanism, such as a rubber seal 62, in the opening to seal around rods 46 so that hot air from inside the tube density separator is not allowed to escape while rods 46 are being slidably moved therein. If rods 46 are capable of being fully removed from tube 12 or block 60, then the sealing mechanism should also be suitable (i.e., self-sealing) for sealing the opening where rods 46 are inserted to prevent loss of air from tube 12. Dispersal rods 46 should be of sufficient length so that the end of the rods 46 in the air stream can be at or near the center of the air stream, if desired. In the preferred embodiment, with slidable rods 46, the distance which distal end 52 of rods 46 project into the air stream can be adjusted by sliding rods 46 in or out of blocks 44 to adjust the flow of material through tube 12 and the amount of dispersing action by rods 46. For instance, if full insertion of rods 46 into tube 12 results in too much resistance, the rods 46 can be withdrawn through blocks 60 a sufficient distance to lower that resistance.

As an alternative embodiment of the present invention, the rods 46 can be fixed inside tube 12. Rods 46 can extend in a fixed manner from or through blocks 60 through wall 54 and into the interior of tube 12. If desired, blocks 60 can be eliminated and the rods 46 affixed directly to the inside of wall 54 of tube 12. In an alternative to rods 46, various other devices can be utilized to accomplish the objectives of rods 46, that is to further enhance the removal of trash and moisture from the cotton fibers. Such devices can include fins, fin-shaped inserts, blades and similar devices which are able to break up the clumps and wads and disperse the cotton and associated foreign matter throughout the air stream inside tube 12.

In the preferred use of the dispersal rods 46, the lower group 56 of rods 46 is located near the bottom 16 of tube 12, as shown in FIG. 1, and comprises four rods approximately ninety degrees apart (along wall 54 of tube 12), as shown in FIG. 1. Upper group 58 is located above lower group 56 (in the direction of air flow) and comprises four rods placed ninety degrees apart from each other, but staggered forty-five degrees from the lower group 56 of rods 46. Viewed from a cut-away through tube 12, whether from below or above, rods 46 would appear as shown in FIG. 4. As shown in FIG. 3, additional groups 64 of dispersal rods 46 may be utilized further up tube 12 as desired for additional dispersing of the clumps and wads. In the preferred embodiment of the use of dispersal rods 46, rods 46 are ⅝" diameter metal rods approximately 30" in length. The rods 46 are inserted through blocks 60 into interior 48 such that they are at an angle of approximately forty degrees off wall 54 of tube 12. Rods 46 of other materials and sizes and placed at other angles can also provide the benefits described above. If desired, rods 46 can be pivotally mounted to blocks 60 or inside tube 12 so that the angle of the rods 46 relative to tube 12 can be adjusted for peak performance.

The use of dispersal rods 46 as set forth above also benefits the drying process. Because the tube density separator 10 will generally, but not exclusively, be used in the heated air line between the drying unit 22 and the cylinder cleaner 40, the dispersion action of rods 46 aids the drying process by affording better exposure of the cotton fibers to the heated air. In fact, the use of dispersal rods 46 projecting into the side of the pipes 26 that are used to convey fibrous material in hot air would greatly enhance the moisture transfer (e.g., drying) by creating slippage between the air and the fibrous material.

Figure 5:
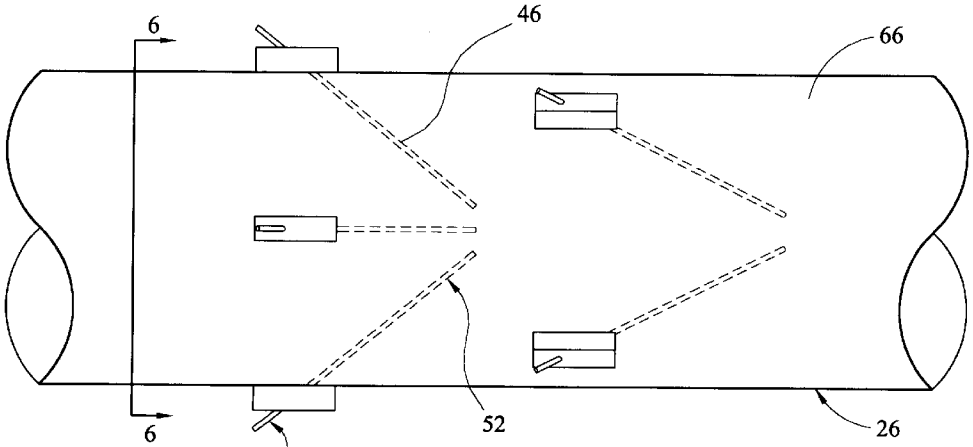
FIG. 5 is a view of dispersing rods in a pipe for carrying cotton.
Figure 6:
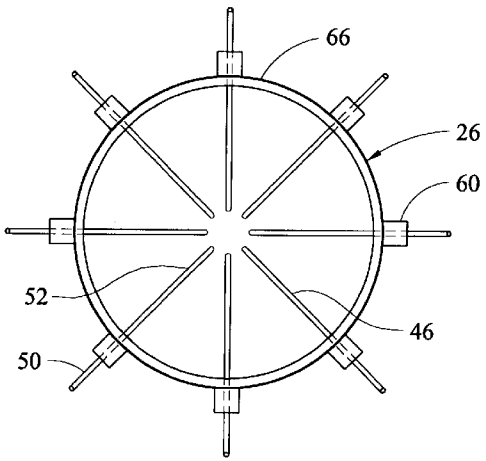
FIG. 6 is a cross-sectional plan view of the pipe of FIG. 5 taken through 6—6 in FIG. 5.

As shown in FIGS. 1 and 5, dispersal rods 46 described above can also be used in the pipes 26 that convey cotton in a heated air stream as part of the drying process (the use of such a pipe 26 having dispersal rods 46 is shown on the far left side of FIG. 1). In a seed cotton drying system in a cotton gin, metal pipes are generally used to convey the cotton in heated air to and from the drying exposure chamber. The moisture transfer from the cotton to the air in the pipe 26 is generally very limited because the air and cotton are traveling at about the same speed. The use of dispersal rods 46 projecting through the pipe 26 into the air and cotton flow will disperse the cotton and slow it down as it makes contact with rods 46. This contact creates slippage between the rate of flow of the air and the cotton fibers, thereby enhancing moisture transfer to the air.

The most advantageous place to locate the dispersal rods 46 is in the pipe 26 immediately following the mix-point, where the temperature is the highest. As shown in FIG. 5, one or more rods 46 (the configuration shown in FIG. 5 utilizes eight rods 46 in two groups of four similar to that set forth above for the tube density separator 10) are inserted through the pipe wall 66 into the air stream that is conveying the cotton materials. The rods 46 can project through blocks 60 mounted on the side of pipe 26. As with the dispersal rods 46 in tube 12, the rods 46 in each group of rods in pipe 26 are offset ninety degrees from each other and the second group of rods (i.e., those downstream of the first group of rods) are offset from the first group by forty-five degrees. All of the rods 46 can be positioned at an angle of forty degrees, or other angle sufficient to break apart the clumps and wads, from the pipe wall 66 and be slidably mounted in blocks 60 to allow the user to adjust the amount of rod 46 insertion if resistance becomes a problem. As with the tube density separator 10, the blocks 60 should have a sealing mechanism that prevents the escape of air from inside of the pipe. The rods 46 can be fixedly mounted inside or to pipe 26, as discussed with the rods 46 in tube 12.

In use, the present invention is utilized in a cotton ginning plant to facilitate the separation of cotton from the mixture of cotton/foreign materials harvested. The user of the present invention supplies a mixture of cotton/foreign materials that is pneumatically disposed in a pipe 24 suitable to transport these materials to the tube density separator 10. The material is received into the bottom 16 of tube 12 at inlet 14. Because the bottom 16 of tube 12 has a larger cross-sectional area than pipe 24 (at inlet 14), turbulence is created and the tumbling action results in some of the foreign material separating from and falling out from the cotton/foreign material mixture. The supply of air from pipe 24 is conveyed up tube 12 and additional separating and falling out of the foreign material occurs. The foreign material that drops out is collected in circular pipe 28. The user also supplies a waste conveying air stream 38 to transport the foreign material away from tube 12. The separated cotton is transported away from the top 20 of tube 12 for further processing (as needed). As discussed above, the above process can be substantially improved by adding dispersal rods 46 to the interior 48 of tube 12. Dispersal rods 46 further break apart and separate the foreign matter from the cotton being conveyed up tube 12. To adjust the amount of resistence to the flow of material up tube 12 caused by rods 46, the rods 46 can be configured to slide in and out of the interior 48 of tube 12 as desired. The waste conveying air stream can be obtained by skimming off a portion of the air flow flowing up the interior 48 of tube 12 (the preferred method). A skimmer 30 can be utilized to separate the air flow in the interior 48 of tube 12 into a primary air stream 32 and a secondary air stream 34, such that the secondary air stream 34 has little or no cotton or other material and it can be used as the waste conveying air stream.

While there is shown and described herein certain specific alternative forms of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to the dimensional relationships set forth herein and modifications in assembly, materials, size, shape, and use.

What is claimed is:

1. A tube density separator for use in a cotton gin, comprising:

a pipe for pneumatically conveying a supply of air having cotton and foreign material mixed therein;

a generally vertical tube having a side wall, a bottom and a top, said side wall enclosing an interior space;

an inlet at said bottom of said tube, said inlet configured to receive said supply of air from said pipe, a cross-sectional area of said bottom of said tube being larger than a cross-sectional area of said pipe at said inlet;

an outlet at said top of said tube, said outlet configured to discharge said supply of air out of said tube;

means below said inlet of said tube for receiving foreign material that drops out of said supply of air;

a waste conveying air stream; and means connected to the receiving means for conveying the foreign material away from said tube with said waste conveying air stream.

2. The tube density separator of claim 1, further comprising dispersing means disposed within said interior of said tube to interact with said supply of air for dispersing the cotton and foreign material in said supply of air.

3. The tube density separator of claim 2, wherein said dispersing means is fixedly disposed in said interior of said tube.

4. The tube density separator of claim 2, wherein said dispersing means is pivotally disposed in said interior of said tube.

5. The tube density separator of claim 2, wherein said dispersing means comprises one or more dispersal rods, each of said dispersal rods having a proximal end and a distal end.

6. The tube density separator of claim 5, wherein each of said dispersal rods is slidably disposed in said interior of said tube for adjusting the position of said distal end of each of said dispersal rods relative to said supply of air.

7. The tube density separator of claim 5 further comprising a block on said side wall of said tube for each of said dispersal rods, each of said dispersal rods disposed through said block and into the interior of said tube.

8. The tube density separator of claim 7 further comprising a seal in said block, said seal disposed around said dispersal rod in said block for preventing escape of said supply of air from said interior of said tube through said block.

9. The tube density separator of claim 7, wherein each of said dispersal rods is slidably disposed in said block for adjusting the position of said distal end of each of said dispersal rods disposed in said interior of said tube.

10. The tube density separator of claim 5, further comprising a booster pump disposed between said skimming means and said conveying means.

11. The tube density separator of claim 2, wherein the cross-sectional area of said top of said tube is approximately equal to the cross-sectional area of said pipe.

12. The tube density separator of claim 1, wherein said generally vertical tube has a uniform taper from said bottom to said top, the cross-sectional area of said top of said tube being smaller than said cross-sectional area of said bottom of said tube.

13. The tube density separator of claim 1, wherein the cross-sectional area of said bottom is substantially larger than the cross-sectional area of said pipe.

14. The tube density separator of claim 1 further comprising means for skimming a portion of said supply of air exiting said outlet into a primary air stream and a secondary air stream, said primary air stream having cotton, said secondary air stream transferred to said conveying means to utilize as said waste conveying air stream.

15. The tube density separator of claim 1, wherein said waste conveying air stream crosses said inlet generally perpendicular to said generally vertical tube.

16. The tube density separator of claim 1, wherein said receiving means is connected to said inlet of said tube.

17. A tube density separator for use in a cotton gin, comprising:

a pipe for pneumatically conveying a supply of air having cotton and foreign material mixed therein;

a generally vertical tube having a side wall, a bottom and a top, said side wall enclosing an interior space;

an inlet at said bottom of said tube, said inlet configured to receive said supply of air from said pipe, the cross-sectional area of said bottom of said tube being larger than the cross-sectional area of said pipe at said inlet;

an outlet at said top of said tube, said outlet configured to discharge said supply of air out of said tube;

dispersing means disposed inside said tube to interact with said supply of air for dispersing the cotton and foreign material in said supply of air;

means at said inlet of said tube for receiving foreign material that drops out of said supply of air;

a waste conveying air stream crossing said inlet generally perpendicular to said generally vertical tube; and means connected to the receiving means for conveying the foreign material away from said tube with said waste conveying air stream.

18. The tube density separator of claim 17, wherein said dispersing means comprises one or more dispersal rods, each of said dispersal rods having a proximal end and a distal end.

19. The tube density separator of claim 18, wherein each of said dispersal rods is slidably disposed in said interior of said tube for adjusting the position of said distal end of each of said dispersal rods relative to said supply of air.

20. The tube density separator of claim 17 further comprising means for skimming a portion of said supply of air exiting said outlet into a primary air stream and a secondary air stream, said primary air stream having cotton, said secondary air stream transferred to said conveying means to utilize as said waste conveying air stream.

21. A method of separating cotton fibers from a mixture of cotton and foreign material, comprising the steps of:

(a) supplying a mixture of cotton and foreign material pneumatically disposed in a supply of air conveyed by a pipe;

(b) receiving said supply of air into a bottom of a generally vertical tube adapted to receive said supply of air, said tube having a top opposite said bottom and a wall enclosing an interior, the cross-sectional area of said bottom of said tube larger than the cross-sectional area of said pipe;

(c) conveying said supply of air through said interior of said tube to promote the separation of the cotton from the foreign material;

(d) collecting the foreign material separated from the cotton in a receiving means below said inlet of said tube;

(e) supplying a waste conveying air stream to a conveying means for conveying the foreign material away from said tube; and (f) transporting said supply of air away from said top of said tube for further processing.

22. The method of claim 21 further comprising dispersing means disposed inside said tube to interact with said supply of air for dispersing the cotton and foreign material in said supply of air.

23. The method of claim 22, wherein said dispersing means comprises one or more dispersal rods, each of said dispersal rods having a proximal end and a distal end.

24. The method of claim 23, wherein each of said dispersal rods is slidably disposed in said wall of said tube for adjusting the position of said distal end of each of said dispersal rods relative to said supply of air.

25. The method of claim 21 further comprising the step of skimming a portion of said supply of air exiting said outlet to form a primary air stream and a secondary air stream, said primary air stream having cotton, said secondary air stream transferred to said conveying means to utilize as said waste conveying air stream.

* * * * *